US010322583B2

(12) United States Patent
Rao et al.

(10) Patent No.: US 10,322,583 B2
(45) Date of Patent: Jun. 18, 2019

(54) PRINTHEAD HAVING TWO ADHESIVES

(71) Applicant: Xerox Corporation, Norwalk, CT (US)

(72) Inventors: Pratima Gattu Naga Rao, Sherwood, OR (US); Sean Campbell Hunter, Portland, OR (US); Christopher Jon Laharty, Oregon City, OR (US); Jonathan Robert Brick, Tualatin, OR (US); John Milton Brookfield, Newberg, OR (US); Tony Russell Rogers, Milwaukie, OR (US); Michael Joel Edwards, Tigard, OR (US); Hong Zhao, Webster, NY (US); Mandakini Kanungo, Penfield, NY (US); Yanjia Zuo, Rochester, NY (US); Daniel R. Hahn, Wilsonville, OR (US); Santokh S. Badesha, Pittsford, NY (US); John R. Andrews, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 263 days.

(21) Appl. No.: 15/221,905

(22) Filed: Jul. 28, 2016

(65) Prior Publication Data

US 2016/0332445 A1 Nov. 17, 2016

Related U.S. Application Data

(62) Division of application No. 14/099,150, filed on Dec. 6, 2013, now Pat. No. 9,427,969.

(51) Int. Cl.
*B41J 2/14* (2006.01)
*B41J 2/16* (2006.01)

(52) U.S. Cl.
CPC ..... *B41J 2/1433* (2013.01); *B41J 2/161* (2013.01); *B41J 2/1623* (2013.01); *B41J 2202/03* (2013.01)

(58) Field of Classification Search
CPC ..... B41J 2/1433; B41J 2/161; B41J 2/1623; B41J 2202/00; B41J 2202/03; B41J 2/14201; B41J 2/045; B41J 2/04588; B41J 2/04595; B41J 2/04586; B41J 2/14274; B41J 11/0015; B41J 11/002;
(Continued)

(56) References Cited

U.S. PATENT DOCUMENTS

2010/0163783 A1* 7/2010 Fung ..... C08G 59/304 252/73
2010/0196590 A1* 8/2010 Shimomura ..... B41J 2/14024 427/58
2011/0273518 A1* 11/2011 Sato ..... B41J 2/14274 347/70

OTHER PUBLICATIONS

Office Action for U.S. Appl. No. 14/099,150, dated Oct. 20, 2015, 14 pages.

(Continued)

*Primary Examiner* — Manish S Shah
(74) *Attorney, Agent, or Firm* — Hoffman Warnick LLC

(57) ABSTRACT

The present teachings describe a printhead assembly. The printhead assembly includes a first plate and a second plate stacked together. The printhead assembly includes a first adhesive between the first plate and the second plate for bonding the plates together. The printhead assembly includes a second adhesive surrounding an outer edge of the first adhesive wherein the second adhesive has an oxygen migration rate lower than an oxygen migration rate of the first adhesive. An oxygen sensitive component is contained within the outer edge of the first adhesive.

11 Claims, 3 Drawing Sheets

(58) Field of Classification Search
CPC ..... B41M 5/0011; B41M 5/0017; B41M 5/0047; B41M 7/00; B41M 7/0072; B41M 5/52; B41M 5/5218
See application file for complete search history.

(56) References Cited

OTHER PUBLICATIONS

Notice of Allowance and Fee(s) Due for U.S. Appl. No. 14/099,150, dated May 12, 2016, 5 pages.

* cited by examiner

PRINTHEAD HAVING TWO ADHESIVES

BACKGROUND

Field of Use

The present disclosure relates to the construction of multiple layer printheads, such as printheads used in solid ink jet printing machines. More particularly, the disclosure concerns the manner in which the multiple layers are adhered together in fabricating the printhead.

Background

Ink jet printing machines include printheads that have one or more ink-filled channels communicating at one end with an ink supply chamber or reservoir and having an orifice at the opposite end, commonly referred to as the nozzle. An energy generator, such as a piezo-electric transducer (PZT), is located within the channels near the nozzle or orifice to produce pressure pulses which produce high velocity droplets directed through the nozzle or orifice toward the receiver sheet.

Typically, adhesives such as cross-linkable acrylic adhesives have been used to bond the layers of the printhead. It would be desirable to improve the bonding of adjacent layers in a jetstack and reduce the size of a printhead while mitigating degradation of internal printhead components due to environmental stresses.

SUMMARY

An aspect disclosed herein describes a printhead assembly having a first plate and a second plate stacked together. A first adhesive is provided between the first plate and the second plate and bonds the plates together. A second adhesive is provided surrounding and spaced an offset distance from an outer edge of the first adhesive. The second adhesive has an oxygen migration rate lower than the first adhesive. An oxygen sensitive component is contained within the outer edge of the first adhesive.

A further aspect disclosed herein is a printhead assembly including a first plate and a second plate stacked together. A first adhesive is provided between the first plate and the second plate for bonding the plates together. A second adhesive is provided that forms channel within the first adhesive creating an interior area of the first adhesive. The second adhesive has an oxygen migration rate lower than the first adhesive. An oxygen sensitive component is contained within the interior area of the first adhesive.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Solid ink jet printing machines and aqueous ink jet printing machines include printheads that include one or more ink-filled channels communicating at one end with an ink supply chamber or reservoir and having an orifice at the opposite end, commonly referred to as the nozzle. An energy generator, such as a piezo-electric transducer, is located within the channels near the nozzle to produce pressure pulses.

Figure 1:
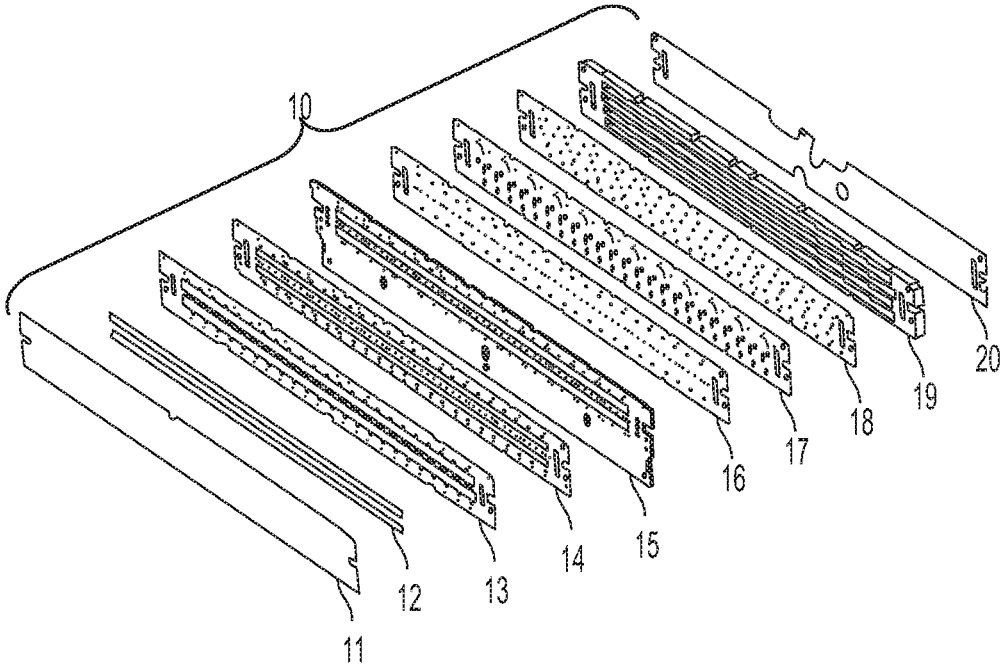
FIG. 1 is an exploded view of the components of a printhead suitable for use in a solid ink printing machine.

One example of a printhead assembly for solid ink printing machines is shown in FIG. 1. The assembly 10 comprises a series of functional plates, each performing an ascribed function for controlled dispensing of the molten or liquid ink onto a substrate passing by the assembly. In a particular embodiment, the printhead assembly 10 includes a top plate 11, PZT arrays 12, and a PZT spacer plate 13, a stand off plate 14, a circuit board 15, a diverter plate 17, a manifold plate 19 and a compliant outer wall 20. The PZT arrays are held between the top plate 11 and the circuit board 15. Also included in the jetstack is an adhesive layer 16 for adhering the diverter plate 17 to the circuit board 15 and an adhesive layer 18 for adhering the diverter plate 17 to the manifold 19. PZT spacer plate 13 and stand off plate 14 act as a spacer between the top plate 11 and the circuit board 15. Circuit board 15 provides electric signals to the transducer for jetting the ink.

The top plate 11 is the nozzle or communicates with a nozzle. Additional plates can optionally be attached to the top plate 11. The plates in printhead 10 are held together with adhesives or in some case brazing if the plates are metal. Plates can be metal such as aluminum and/or stainless steel, or a polymer such as polyimide, polysulfone, polyetherimide, etc. However, improved printheads have utilized polymer adhesives to join the components of the stack. In particular, an adhesive is applied between adjacent printhead components and the stack is heated and compressed until the adhesive cures. One adhesive example is a thermoset modified acrylic polymer known as R1500. It has been found that adhesives, such as the R1500 adhesive have excellent properties such as modulus at the printhead operating temperatures, adhesive strength and compatibility with the ink chemistry.

R1500 provides a suitable adhesion for holding adjacent plates together. However, R1500 is susceptible to oxygen migration at certain operating temperatures of the printhead. Certain components of the printhead assembly are degraded when exposed to oxygen. When oxygen reaches a PZT array, the PZTs can become separated from the diaphragm plate, and jetting performance will degrade to unacceptable levels. This is due to the oxidative degradation experienced by the adhesive which is used to bond the PZT array to the diaphragm. As such, the PZT array 12 can detach from top plate 11. When the PZT arrays 12 detach from the top plate 11, the printhead 10 no longer jets ink accurately.

The R1500 adhesive storage modulus is about 30 MPa at temperatures of about 25° C. The storage modulus decreases as the temperature increases. The storage modulus is about 3 MPa at a temperature of about 120° C. The lap shear strength of the R1500 adhesive, measured through lap shear coupon testing is greater than 400 psi at temperature near 120° C.

As printhead assemblies become smaller, there is less area available for an adhesive to bond adjacent plates in the jetstack which makes the inner components more susceptible to oxygen exposure in shorter timescales. In addition, the temperature at which the printhead 10 operates has an impact on oxygen migration. Operating temperatures of the printhead 10 can reach 140° C. Described herein is a bonding system for printhead assemblies to prevent internal failures.

In an embodiment, an internal channel is provided in a first or interior adhesive. A second or exterior adhesive used to fill the channel and which is resistant to oxidation and oxygen migration, significantly reduces the rate of oxygen migration into the interior adhesive layer. The life of oxygen sensitive components within the first or primary adhesive layer is extended. The presence of the first adhesive on either side of the second adhesive constrains the second adhesive and controls its flow into unintended areas of the printhead, which may affect other functions of the printhead. Tangible benefits from this application include a decrease in the overall size of the printhead and improved confidence in printhead reliability performance.

Figure 2:
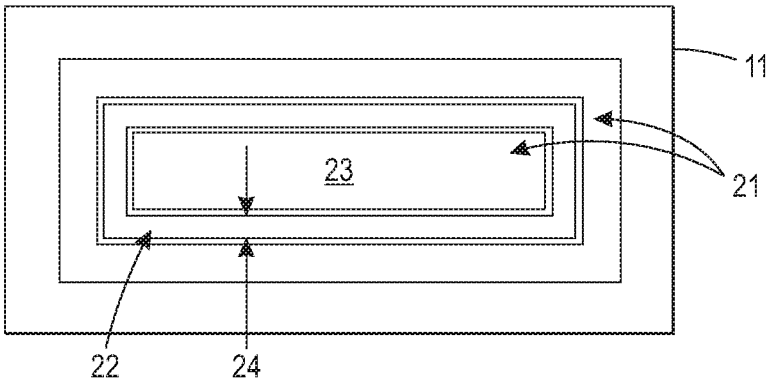
FIG. 2 is a planar view of a plate of printhead assembly according to an embodiment described herein.
Figure 3:
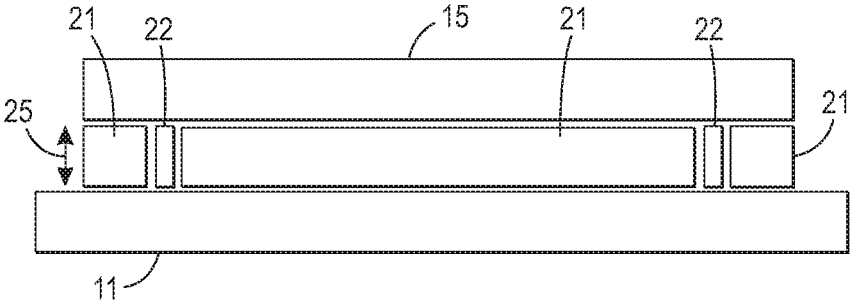
FIG. 3 is a sectional view of components of a printhead assembly according to an embodiment described herein.

Referring to an embodiment in FIG. 2 and FIG. 3, a plate assembly is shown FIG. 2 shows a planar view of top plate 11 with the first adhesive 21 and second adhesive 22 bonded to it. FIG. 3 shows a sectional view of the assembly of top plate 11 through circuit board 15 bonded with the first adhesive 21 and second adhesive 22. These figures are exemplary of other layers of the jetstack which contain oxygen-sensitive components. In FIG. 3, circuit board 15 can include other inkjet plates of the jetstack shown in FIG. 1. Top plate 11 can also include other inkjet plates. A second adhesive 22 surrounds an outer edge of the first adhesive 21 and creates interior area 23 where the PZT arrays (not shown) are positioned. The first adhesive 21 surrounds the second adhesive 22 in the embodiment shown in FIG. 2 and FIG. 3. The second adhesive 22 has an oxygen migration rate lower than the first adhesive 21.

In some cases, the first adhesive 21, on the interior, may be required to have certain mechanical properties, such as a particular modulus of elasticity. R1500, which is a B-staged modified acrylic adhesive, has, upon curing, a modulus of elasticity, E', as measured with a Dynamic Mechanical Analyzer, of about 3 MPa at about 120° C. It also has transition peaks at 15° C. and 60° C. The second adhesive 22 is laid in the gap between the two pieces of the first adhesive 21. The second adhesive 22 exhibits oxygen migration resistant properties that protect the oxygen sensitive components of the printhead assembly 10 from degrading in the presence of oxygen. Tangible benefits from this application include a decrease in the overall size of the printhead and improved confidence in printhead reliability performance.

The geometry shown in FIG. 2 and FIG. 3 is defined by the width 24 of the second adhesive 22 and the thickness 25 (FIG. 3) of the second adhesive 22. The width 24 (FIG. 2) of second adhesive 22 is from about 0.1 mm to about 20 mm, or in embodiments from about 0.5 mm to about 10 mm or from about 1 mm to about 5 mm. The second adhesive 22 has an oxygen migration rate or oxygen transmission significantly less than the oxygen migration rate of the first adhesive. The thickness 25 (FIG. 3) of the of second adhesive layer 22 is from 0.05 mm to about 2 mm, or in embodiments from about 0.1 mm to about 1 mm or from about 0.1 mm to about 0.25 mm.

In an alternate embodiment, there is provided a first adhesive and a second adhesive surrounding the first adhesive. The second adhesive is spaced a distance or offset from the first adhesive. The presence of the offset prevents the second adhesive from flowing into unintended areas of the printhead, which can affect other functions of the printhead. Tangible benefits from this application include a decrease in the overall size of the printhead and improved confidence in printhead reliability performance.

Figure 4:
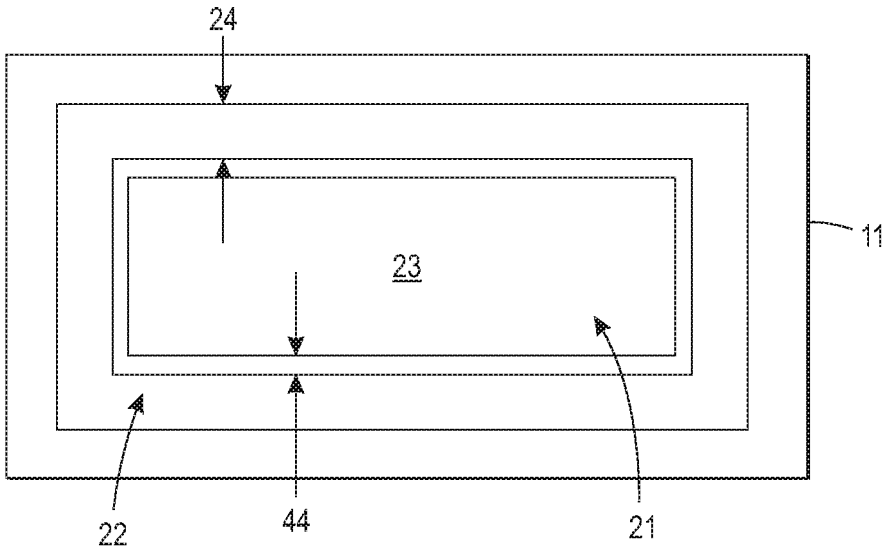
FIG. 4 is a planar view of a plate of printhead assembly according to an embodiment described herein.
Figure 5:
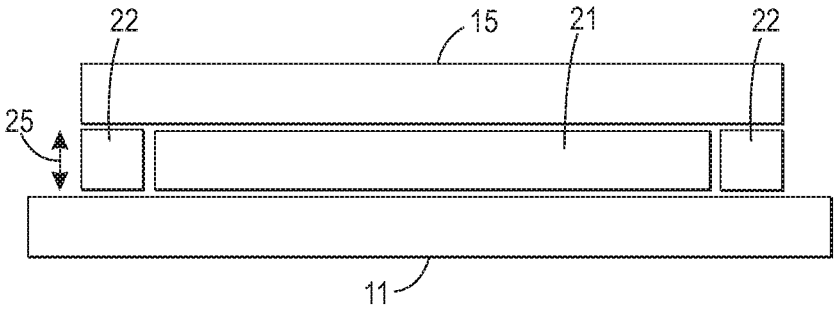
FIG. 5 is a sectional view of components of a printhead assembly according to an embodiment described herein.

Referring to an embodiment in FIG. 4 and FIG. 5, a plate assembly is shown. FIG. 4 shows a planar view of top plate 11 with the first adhesive 21 and second adhesive 22 bonded to it. FIG. 5 shows a sectional view of the assembly of top plate 11 through circuit board 15 bonded with the first adhesive 21 and second adhesive 22. These figures are exemplary of other layers of the jetstack which contain oxygen-sensitive components. The second adhesive 22 surrounds an outer edge of the first adhesive 21 and creates interior area 23 where the PZT arrays (not shown) are positioned. An offset 44 is provided between the first adhesive 21 and the second adhesive 22. The second adhesive 22 has an oxygen migration rate lower than the first adhesive 21.

The geometry of the embodiment shown in FIG. 4 and FIG. 5 is defined by three primary dimensions: the width 24 of the second adhesive 22, the linear offset 44 between the second adhesive 22 and the first adhesive 21, and the thickness 25 (FIG. 5) of the second adhesive 22.

The width 24 (FIG. 4) of the second adhesive is driven by several contributing factors. The second adhesive 22 fills any gaps in the printhead assembly 10 (FIG. 1) due to tolerance mismatches. The width 24 must allow for the second adhesive to squeeze out into these gaps while maintaining the integrity of the perimeter created by the second adhesive 22. The allowance for squeeze-out to fill gaps contributes to the planarity of the resulting assembly. Planarity amongst the layers of the printhead assembly 10, or jetstack, is a critical component of printhead performance. Sufficient width 24 is required to maintain the planarity of the exterior adhesive layer after squeeze-out occurs. The width 24 also impacts the capabilities of the assembly process. Too narrow of a width 24 may yield difficulties in the placement of the second adhesive 22. This has the potential to complicate the planarity and gap sealing competencies, in addition to adding significant manufacturing costs. The width 24 (FIG. 4) of second adhesive 22 is from about 0.1 mm to about 100 mm, or in embodiments from about 0.5 mm to about 20 mm or from about 1 mm to about 10 mm.

The linear offset 44 between the first adhesive 21 and the second adhesive 22 serves at least two purposes. First, the mechanical properties of the exterior adhesive require that it not interact with the outer edge of the PZT array, lest it detrimentally alter the jetting characteristics of the printhead. The linear offset 44 allows for squeeze-out of the adhesive without breaching the interior area 23 containing the oxygen sensitive component such as the PZT array 12 (FIG. 1). Secondly, the linear offset 44 reduces the precision required for accurate placement outside of the interior adhesive. The offset 44 is from 0.05 mm to about 2 mm, or in embodiments from about 0.1 mm to about 1.5 mm or from about 0.5 mm to about 1 mm. Overlapping the interior and exterior adhesives could yield planarity issues and material interactions of unknown criticalities.

The thickness 25 of the second adhesive must provide sufficient volume of adhesive to seal the aforementioned gaps in the jetstack. The thickness 25 is also driven by the requirements that, in order to generate a complete bond, the final stack-up must achieve a satisfactory level of planarization and allow for the adequate compression of the interior adhesive. The thickness 25 (FIG. 5) of the second adhesive layer 22 is from 0.05 mm to about 2 mm, or in embodiments from about 0.1 mm to about 1.5 mm or from about 0.5 mm to about 1 mm. The thickness 25 impacts the assembly process: an ultra-thin adhesive is difficult to place accurately.

Adhesive 21 can be a cross-linkable acrylic adhesive or thermoplastic polyimide. The assembly is maintained at an optimum temperature and pressure to perfect adhesive interface between the plates 11 and 15 to cure the adhesives to the metallic substrates being joined.

Adhesive 22 can be an epoxy film adhesive. The second adhesive 22 has an oxygen migration rate lower than the first adhesive. In an embodiment, the second adhesive is a blend of base components including two bisphenol epoxy resins, cresol resin, an imidazole amine hardener, and a latent curing agent dicydiandiamide (DICY). This adhesive is referred to as TF0063-86. The structures of the components are as follows. The first bisphenol epoxy from about 11 weight percent to about 17 weight percent of the second adhesive. The structure is represented by:

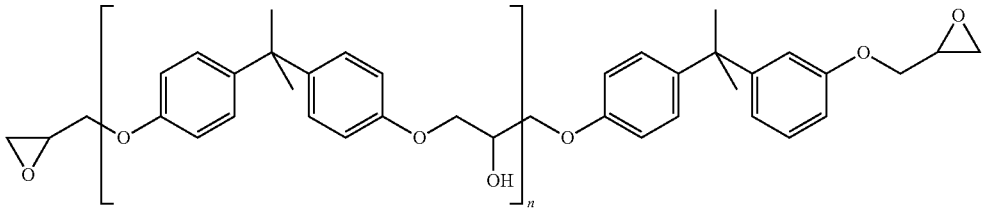

wherein n is from about 1 to about 25, or in embodiments from about 3 to about 15 or from about 5 to about 8.

The second bisphenol epoxy is from about 5 weight percent to about 7 weight percent of the second adhesive. The structure is represented by:

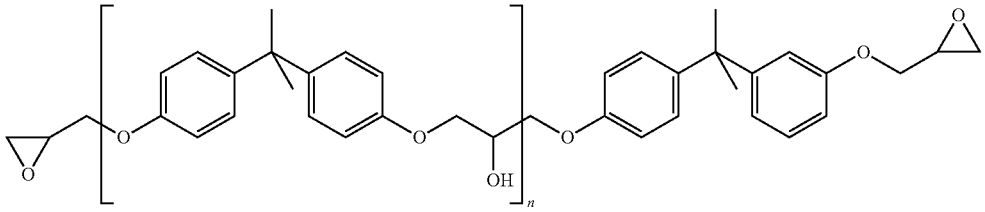

wherein n is from about 1 to about 300, or in embodiments from about 10 to about 250 or from about 50 to about 200.

The cresol epoxy is from about 68 weight percent to about 72 weight percent of the second adhesive. The structure is represented by:

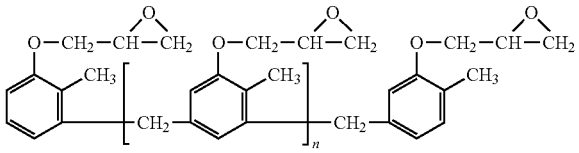

wherein n is from about 1 to about 30 or in embodiments from about 2 to about 18 or from about 3 to about 10.

The dicydiandiamide is from about 2 weight percent to about 3 weight percent of the second adhesive. The structure is represented by:

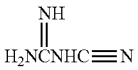

DICY is a representative latent curing agent that forms crystals when processed in accordance with the present teachings. It may be used in the form of a fine powder dispersed within the resin. This material can enable a very long pot life, for example 6 to 12 months. DICY enables curing at a high temperature, for example from about 160° C. to about 180° C. in about 20 minutes to about 60 minutes. Cured DICY resins have a good adhesiveness and are less prone to staining than some other resins. DICY may be used in one-part adhesives, powder paints, and pre-impregnated composite fibers (i.e., "pre-pregs").

The imidazole amine hardener is from about 1 weight percent to about 2 weight percent of the second adhesive. The structure is represented by:

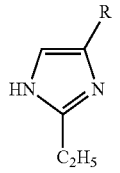

wherein R is a hydrogen or alkyl. Imidazole amine hardener is a co-curing agent. Imidazoles are characterized by a relatively long pot life, the ability to form cured resin with a high heat deformation temperature by thermally treating at a medium temperature (80° C. to 120° C.) for a relatively short duration, and the availability of various derivatives having moderate reactivity that improves workability. When used as a co-curing agent with DICY, imidazole can exhibit a better pot life, a faster curing speed, and a higher heat resistance of the cured substance than when an adhesive is used with some other co-curing agents. Some representative chemical structures of various imidazoles, one or more of which may be included as a co-curing agent, include:

1-methylimidazole;

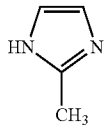

And 2-ethyl, 4-methyl imidazole;

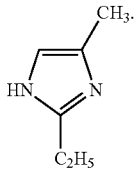

The blend of the bisphenol epoxies and the cresol epoxy coupled with the amine hardener and latent curing agent (DICY) provide improved oxidation migration, good workability, long pot life, and higher heat resistance. Additionally, the small amount of the DICY latent curing agent present (about 2 weight percent to about 3 weight percent) reduces the number of amine linkages in the cured material which are, otherwise, susceptible to oxidative attack. The combination of resins and curing agent chemistries and ratios provide an extended pot life at room temperature.

Solvents suitable for the second adhesive include for example, 2-butoxy ethanol and 2-butoxy ethyl acetate, and are used to dilute the uncured epoxy blend such that the material can be coated onto a liner and be used as a film. In addition, a minimum amount of the solvent is left behind for continued easy handling of the adhesive films. Laser-ablation work has shown this film epoxy can be cut into specific geometries with the needed accuracies.

The advantage of using multiple adhesives in jetstacks of an inkjet printer include printhead reliability over its lifetime and a smaller total adhesive area.

The cured and adhesively bonded epoxy film that forms during the curing process must exhibit resistance to oxygen migration under the full range of operating conditions of the printhead. The bonding conditions (time, pressure, temperature) must be compatible with the existing process cycles seen by the printhead. The tack process is at a pressure of about 30 psi and a temperature of about 70° C. for about 2 minutes. This is followed by drying with the liner in place and using a hotplate or oven at about 85° C. for about 45 minutes. The final step is to bond using conditions of about a pressure of 195 psi at 195° C. for about 70 minutes.

Specific embodiments will now be described in detail. These examples are intended to be illustrative, and not limited to the materials, conditions, or process parameters set forth in these embodiments. All parts are percentages by solid weight unless otherwise indicated.

Examples

A series of experiments was conducted using adhesives to determine certain properties. Adhesive TF0063-86 was obtained as strips having removable liners on each side of the strip. The release liner was removed from one side and the exposed adhesive placed on the first glass plate. The adhesive was heated to about 50° C. to about 70° C. to tack. The first substrate was cooled to room temperature and the second release liner was removed and aligned with the second glass plate. The assembly of the two glass plates and the adhesive was cured at about 120° C. for 15 minutes. The assembly was bonded together at a pressure of about 55 psi at a temperature of about 190° C. for about 70 minutes.

The assemblies described above were aged in air at three different temperatures: 115° C., 140° C., and 170° C. Exposure to air was along the edges of the film samples. Therefore, these structures mimic the exposure to oxygen in the printhead which is also only along the edges of the film. Results after two weeks of aging showed very light color change to the edges of the sample maintained at 115° C. There was increased darkening along the edges for the sample aged at 140° C., and more pronounced darkening was present at when aged 170° C. The darkening of the edges are thermo-oxidation changes. With increasing temperature, only the edge of the film darkened further with no progression of color change, accelerated or otherwise, through the body of the film.

Similar tests were conducted using R1500 as the adhesive between two glass plates. R1500 is a modified acrylic adhesive. With only one week at 140° C. in air, the R1500 film darkened throughout its body. This was compared with two weeks at 140° C. in air for the TF0063-86 adhesive which had only darkening along the edges. This overall darkening of the R1500 was also attributed to thermo-oxidation effects and supported separate testing that demonstrated the unsuitability of the R1500 film to adequately and exclusively protect sensitive printhead components from oxidation.

The TF0063-86 adhesive showed good bond strength following aging. Results show that unaged or lab air conditions as well as aging conditions of air and nitrogen ($N_2$) yielded comparable lap shear strengths. No deterioration of bond strength was observed in any of these aging environments, particularly in air at 140° C. which represents an aggressively oxidative environment compared with an ink environment or a room temperature environment.

The TF0063-86 adhesive was applied in the printhead as an exterior window-frame adhesive as shown in FIG. 4 and FIG. 5. Adhesive TF0063-86 was obtained as strips having removable liners on each side of the strip. The conditions for applying the adhesive were a pressure of 195 psi at a temperature of 190° C. for 70 minutes. The release liner was removed from one side and the exposed adhesive placed on the inkjet plate circuit board 15 with an offset 44 from adhesive 21 (FIG. 4). The assembly was heated to about 70° C. to tack. The assembly was cooled to room temperature and the second release liner was removed and aligned with the top plate 11. The printhead assembly was held together at a pressure of about 195 psi at a temperature of about 195° C. for about 70 minutes to form a bond.

Results from testing of the printhead assemblies were determined from visual inspection, i.e. darkening of the adhesive from thermo-oxidative effects. The assemblies were aged for 10 months in air at 140° C. No evidence of discoloration was observed in the interior adhesive with the TF0063-86 in place.

Other embodiments of the present teachings will be apparent to those skilled in the art from consideration of the specification and practice of the present teachings disclosed herein. It is intended that the specification and examples be considered as exemplary only, with the true scope and spirit of the present teachings being indicated by the following claims.

What is claimed is:

1. A printhead assembly comprising:

an oxygen-sensitive component;

a first plate and a second plate;

an effective amount of a first adhesive component applied to respective surface portions of each of the first and second plates for adhesively bonding the first and second plates together; and an effective amount of a second adhesive component between the first plate and the second plate, combined with and disposed in the first adhesive component, providing an interior region that defines a channel within the first adhesive component, wherein the second adhesive component possesses an oxygen-migration rate that is less than an oxygen-migration rate for the first adhesive component, and wherein the oxygen-sensitive component is disposed in the channel of the first adhesive component.

2. The printhead assembly of claim 1, wherein the channel has a width of 0.05 mm to about 2 mm.

3. The printhead assembly of claim 1, wherein the second adhesive component comprises: a first bisphenol epoxy, a second bisphenol epoxy, a cresol epoxy, an amine hardener, and a curing agent.

4. The printhead assembly of claim 3, wherein the first bisphenol epoxy comprises from about 11 weight percent to about 17 weight percent of the second adhesive, the second bisphenol adhesive comprises from about 5 weight percent to about 7 weight percent of the second adhesive, the cresol epoxy comprises from about 68 weight percent to about 72 weight percent of the second adhesive, the amine hardener comprises from about 1 weight percent to about 2 weight percent of the second adhesive and the curing agent comprises from about 2 weight percent to about 3 weight percent of the second adhesive.

5. The printhead assembly of claim 3, wherein the first bisphenol epoxy is represented by:

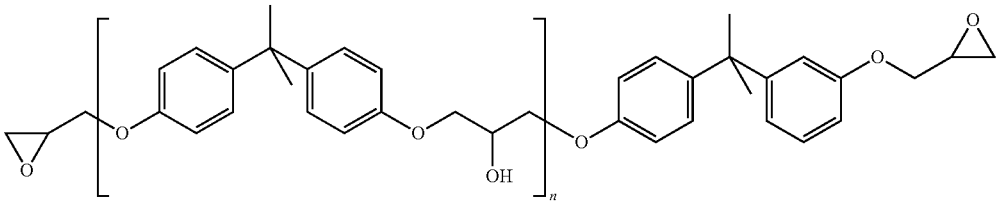

wherein n is from about 1 to about 25.

6. The printhead assembly of claim 3, wherein the second bisphenol epoxy is represented by:

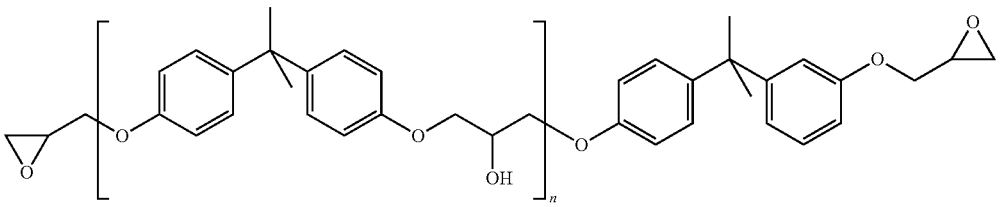

wherein n is from about 1 to about 300.

7. The printhead assembly of claim 3, wherein the cresol epoxy is represented:

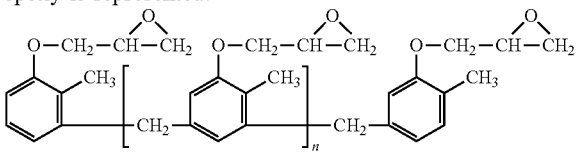

wherein n is from about 1 to about 30.

8. The printhead assembly of claim 3, wherein the amine hardener is represented by:

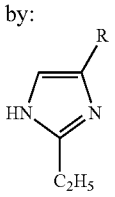

wherein R is a hydrogen or alkyl.

9. The printhead assembly of claim 3, wherein the curing agent is represented by:

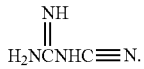

10. The printhead assembly of claim 1, wherein the first plate and the second plate are formed of a material selected from the group consisting of metal, ceramic and plastic.

11. The printhead assembly of claim 1, further comprising functional plates stacked on the first plate or the second plate.

* * * * *